US007264208B2

(12) United States Patent
Kovach et al.

(10) Patent No.: US 7,264,208 B2
(45) Date of Patent: Sep. 4, 2007

(54) CONTROL FOR OPERATING FEATURES OF A MODEL VEHICLE

(75) Inventors: Louis Kovach, Belleville, MI (US); Neil P. Young, Redwood City, CA (US); James Rohde, Walled Lake, MI (US); John Ricks, Lincoln Park, MI (US)

(73) Assignee: Lionel L.L.C., Chesterfield, MI (US)

( * ) Notice: Subject to any disclaimer, the term of this patent is extended or adjusted under 35 U.S.C. 154(b) by 0 days.

(21) Appl. No.: 10/631,311

(22) Filed: Jul. 31, 2003

(65) Prior Publication Data

US 2004/0113022 A1 Jun. 17, 2004

Related U.S. Application Data

(63) Continuation-in-part of application No. 10/617,003, filed on Jul. 10, 2003.

(60) Provisional application No. 60/394,550, filed on Jul. 10, 2002.

(51) Int. Cl.
*B61L 3/00* (2006.01)
*B60L 15/00* (2006.01)

(52) U.S. Cl. ..... 246/167 R; 104/295

(58) Field of Classification Search ..... 246/1 R, 246/4, 1 C, 2 R, 3, 167 R, 187 A, 187 B; 104/287, 288, 295, DIG. 1
See application file for complete search history.

(56) References Cited

U.S. PATENT DOCUMENTS 4,914,431 A 4/1990 Severson et al.
5,184,048 A 2/1993 Severson et al.
5,251,856 A * 10/1993 Young et al. ..... 246/4
5,394,068 A 2/1995 Severson et al.
5,441,223 A 8/1995 Young et al.
5,749,547 A * 5/1998 Young et al. ..... 246/4
6,113,458 A 9/2000 Brown
6,320,346 B1 11/2001 Graf
6,441,570 B1 8/2002 Grubba et al.
6,457,681 B1 10/2002 Wolf et al.

OTHER PUBLICATIONS

M.T.H. Electric Trains Z-4000 400-Watt Transformer Operating Instructions, http://www.mth-railking.com—printed Aug. 12, 2003.
Lionel Electric Trains Trainmaster Command: The Complete Guide to Command Control—published 1995 U.S.A.
Trainmaster Command Control and Conventional Power, http://www.lionel.com/products/catalogs/cat-2002-C-1/pgs-98-99.htm—printed Jun. 17, 2002.

* cited by examiner

*Primary Examiner*—S. Joseph Morano
*Assistant Examiner*—Robert J. McCarry, Jr.
(74) *Attorney, Agent, or Firm*—O'Melveny & Myers LLP

(57) ABSTRACT

An apparatus for controlling operating features of a model train includes a plurality of selection devices, each of which corresponds to a respective operating feature of the train. The apparatus also includes a controller connected to the selection devices of the apparatus. The controller is operative to generate control signals such as digital messages or DC offset signals corresponding to the selection devices. The apparatus further includes a plurality of switches to control the form the control signals take, and a transmitter connected to the controller. The transmitter is operative to send the digital or DC offset messages that are generated by the controller to a receiver located on the train in order to carry out the desired functions. This invention provides for at least a single button output of complex messages.

28 Claims, 6 Drawing Sheets

CONTROL FOR OPERATING FEATURES OF A MODEL VEHICLE

RELATED APPLICATIONS

This is a continuation in part (CIP) application of U.S. patent application entitled "CONTROL FOR OPERATING FEATURES OF A MODEL VEHICLE" filed on Jul. 10, 2003, now pending, Ser. No. 10/617,003 with the listed inventors being Louis Kovach, James Rohde and Neil Young, which claims the benefit of U.S. provisional application Ser. No. 60/394,550 filed Jul. 10, 2002. Applications U.S. Ser. No. 10/617,003 and U.S. 60/394,550 are both hereby incorporated by reference in their entirety.

BACKGROUND OF THE INVENTION

1. Field of the Invention

The present invention relates in general to the control of a model vehicle such as a model toy train and more particularly to a control for operating features of the same.

2. Description of the Related Art

Model train enthusiasts have always desired the ability to control a number of functions of one or more model trains on a track. Early trains had only a single feature, the motor of the train was "on" or it was "off." In the typical modern system, the train engine is an electrical engine receiving power from the train tracks. The train motor typically picks up the power from a voltage applied to the tracks through contacts on the bottom of the train or through train wheels. The amplitude and polarity of the voltage applied to the tracks controls the speed and direction of the train. In HO systems, this voltage is a direct current (DC) voltage. More commonly, particularly for O-gauge systems, this voltage is an alternating current (AC) voltage. In conventionally controlled AC voltage systems, in order to change the direction of the train, the AC signal is removed and reapplied to the track.

One approach for controlling on-board functions of a train is to superimpose a DC voltage on top of such an AC track voltage applied to the track. The applied DC voltage forms a DC offset on the track (i.e., the AC track voltage is normally "balanced"). The DC offset is detected by a DC receiver mounted on the train, activating an onboard device, such as a whistle or the like. Trains so equipped are responsive to track power changes and a single DC offset. A later improvement included applying DC offsets of different polarities and amplitudes, increasing the number of on-board functions that could be implemented. In the O-gauge market, model trains responsive to changes in track power (for control of the speed) and DC offsets (for control of the features or functions) are referred to as being controlled in a conventional mode.

U.S. Pat. Nos. 4,914,431, 5,184,048 and 5,394,068 issued to Severson et al. disclose a method of increasing the number of control signals available by the incorporation of a state machine in the train. Model trains responsive to this method may include a state machine whereby a plurality of key presses of a remote control device change the state of the state machine and activate a feature of the train associated with that state. However, use of this system may require that the user learn a sequence of key presses.

More recently, so-called command control techniques have been applied to model trains. For example, U.S. Pat. Nos. 5,251,856, 5,441,223 and 5,749,547 to Young et al. disclose, among other things, providing a digital message, which may include a command, to a model train using various techniques. The digital message(s) so produced are typically read by a decoder mounted on the train, which then executes the decoded command. Operating such a system involves manipulating a remote control and some particularly advanced features may require programming.

Other systems have been introduced, but have been perceived as difficult to program by some users, particularly when model trains associated with different control systems are used on a common track. Because of the perception by certain users, many model toy trains with such internal electronics are run on layouts without the associated controls needed to actually activate those electronics. Instead, a transformer merely supplies power to the tracks and the model train is operated in conventional mode. Thus, in some circumstances, the advanced operating features of these modern model trains are not fully utilized.

Therefore, a need exists for a system that minimizes or eliminates one or more of the problems or challenges noted in the Background.

SUMMARY OF THE INVENTION

An apparatus for controlling operating features of a model train is presented. An apparatus in accordance with the present invention includes a plurality of selection devices each of which correspond to a different operating feature of the train. An apparatus according to the present invention also includes a controller connected to the selection devices which is operative to generate control signals, such as digital messages or DC offset signals, configured to activate an operating feature based on user input through the selection devices, and a plurality of switches to control the form the control signals take. An apparatus in accordance with the present invention further includes a transmitter connected to the controller that is operative for sending control signals to a receiver located on the train. The receiver is configured to receive the control signal, and execute the same to activate the operating feature.

These and other features and objects of this invention will become apparent to one skilled in the art from the following detailed description and the accompanying drawings illustrating features of this invention by way of example.

DETAILED DESCRIPTION OF THE PREFERRED EMBODIMENTS

Figure 1:
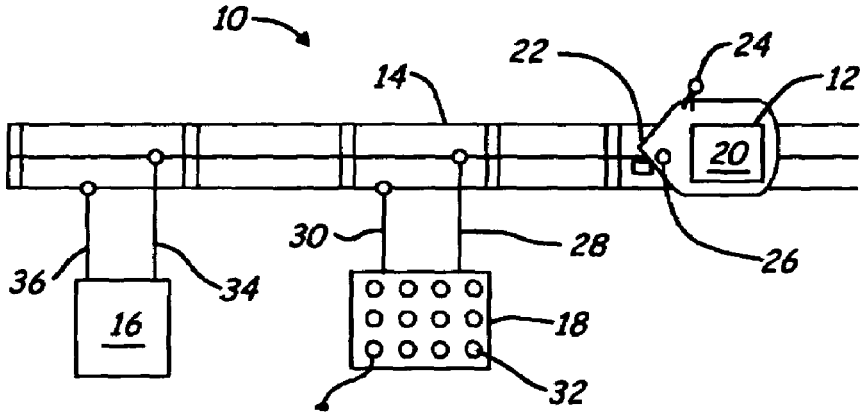
FIG. 1 is a simplified diagrammatic and block diagram view of a model toy train layout including a control box according to one embodiment of the present invention.

Referring now to the Figures wherein like reference numerals are used to identify like components in the various views, FIG. 1 is a top plan view illustrating a model toy train layout 10. Train layout 10 includes at least one model train 12, a track 14 upon which train 12 travels, a transformer 16, and a control box 18. Train 12 includes control electronics 20, which can be any electronics mounted upon a model train 12. For example, the control electronics 20 can include simple or advanced DC or AC motor control, depending upon the motor of the model train 12. Control electronics 20 may additionally include electronics that control various operating features of the train, such as lights 22, a horn 24 and/or a smoke stack 26, as shown in FIG. 1. One feature of the present invention is that it allows, in one embodiment, the user to obtain speed control via conventional throttle adjustments on a conventional variable output transformer, thus maintaining a familiar interface for speed control. In this regard, the control box 18 looks at the track voltage, infers a commanded speed and then sends out a command to the model train 12, while additionally allowing the user to activate various operating features through the inventive control box 18.

The assignee of the present invention provides command control products under its TRAINMASTER trademark consistent with U.S. Pat. Nos. 5,251,856, 5,441,223 and 5,749,547 to Young et al., each hereby incorporated by reference in its entirety. For simplicity, this command control protocol will be referred to hereinafter as TRAINMASTER, TRAINMASTER-equipped, or TRAINMASTER-compliant. However, it should be understood that this type of command control protocol is used for exemplary purposes only and is not meant to be limiting in nature. In a constructed embodiment, control box 18 is configured to control TRAINMASTER-equipped model trains (i.e., consistent with U.S. Pat. Nos. 5,251,856, 5,441,223 and 5,749,547). In an alternate embodiment, control box 18 is implemented with an alternate protocol for controlling model trains equipped with such alternate protocol, for example only, including the protocol described in U.S. Pat. Nos. 4,914,431, 5,184,048 and 5,394,068 to Severson et al., each of which is hereby incorporated by reference in its entirety. In still another embodiment, control box 18 is configured to control model trains compliant with multiple, different model train operating protocols. For example, control box 18 may be configured, in such other embodiment, to control model trains compliant with TRAINMASTER command control, and to control model trains compliant with the protocol(s) described in the U.S. Patents issued to Severson et. al. noted above. The particular protocol used may, for example only, be made selectable on control box 18.

It should be understood that model train 12 and control box 18 must operate in accordance with the same protocol. For example only, in a constructed embodiment, control box 18 is configured with the TRAINMASTER protocol. Upon powering up, control box 18 generates a signature signal that indicates the presence of a TRAINMASTER compliant control attached to the layout 10. A TRAINMASTER-equipped model train is configured to detect this signature signal and automatically configure (or reconfigure) itself for TRAINMASTER command control operation. Through this mechanism, both control box 18 and model train 12 are operating in accordance with the same protocol. Of course, other configuration approaches are possible to configure the control box 18 and the model train (or trains) to operate under the same protocol (e.g., hard switches on the model train).

With continued reference to FIG. 1, for a single train operating on a single block of track, a two-wire hookup, labeled as connectors 28 and 30, is used between the control box 18 and the tracks 14, for supplying control signals to the tracks 14 originating from the control box 18. In the embodiment shown in FIG. 4, control box 18 may be configured to control model trains operating on a plurality of blocks, for example, two blocks; or for two trains operating on a single block of track. For such a two block arrangement, a second two-wire connector hookup (not shown) is provided to connect control box 18 to the second block of track 14, wherein like connections are made to the second block as in the first block. For the arrangement where two trains are operating on a single block of track 14, two transformers are used, wherein a first transformer provides input to one of the trains and power to both of the trains, and a second transformer provides input to the other train, but does not provide power to either train.

With reference to FIG. 1, transformer 16 supplies power to track 14 through connectors 34, 36, while control box 18 is powered by conventional wall outlet. Transformer 16 can be a conventional AC or DC transformer, depending on the requirements of the layout, and in particular, the model train 12. Additionally, transformer 16 may provide either a fixed output or a variable output. The type of transformer used will depend on the embodiment of control box 18 being used. For the first embodiment of control box 18 shown in FIG. 2, a variable-output transformer 16 is provided such that conventional control of the speed and direction of model train 12 may be retained, yet allowing the user a simplified access to the operating features of model train 12 controlled through an advanced, command control protocol, such as TRAINMASTER for example only. For a second embodiment shown in FIG. 3, however, a fixed output transformer 16 may be used, inasmuch as the embodiment of FIG. 3 allows for the control or adjustment of the voltage actually applied to the track using control box 18. In a fixed output transformer arrangement, the voltage level may be controlled by the use of a button, potentiometer, remote control, or the like. Alternately, for the embodiment of FIG. 3, a variable output transformer 16 may be used wherein the user adjusts the output to a high or maximum level so as to functionally equip it as fixed output transformer. In a constructed embodiment, the layout is an O-gauge layout and the transformer is an AC transformer.

In operation, transformer 16 transforms typical AC line voltage (e.g., 120 VAC) to a reduced level (e.g., 0-18 VAC for a conventional O-gauge variable output model train transformer) and supplies the same to track 14.

Control box 18 includes a plurality of selection devices, such as pushbuttons 32, that allow for user input. For example, in FIGS. 1-2, twelve (12) pushbuttons, as shown, are mounted in the casing of the control box 18. It is evident that the number of pushbuttons 32 shown, are by example only. Thus, more or less than twelve operating features can be labeled on the control box 18 and operated by the pushbuttons 32. Each pushbutton 32 can be labeled with an advanced feature available to the user, depending upon the capability of the particular train 12 or trains being operated. The pushbutton activated operating features may include, but are not limited to, "horn," "bell," "brake," "boost," "front coil coupler," "rear coil coupler," "advanced voice features," "smoke control," etc. It will also be evident from the discussion herein that pushbuttons 32 are not necessary. Control box 18 can instead incorporate any means of switching between at least two states, including, but not limited to, toggle switches or contact pads or the like. Control box 18 receives input information entered by the user through pushbuttons 32. Control box 18 then determines the nature of the desired action and formats a command configured to effect the desired action in accordance with the protocol in effect (or selected for operation of control box 18). Control box 18 is then configured to generate suitable signals and supply such signals through the connectors 28, 30 provided to the track 14. The supplied signal is thus configured to operate the corresponding operating feature of the train 12 as indicated by the selected pushbutton 32. The control electronics 20 of the train 12 are configured to receive the supplied signals and respond to such signals by activating the operating feature the user selects from the plurality of available operating features as indicated by the pushbuttons 32.

Figure 2:
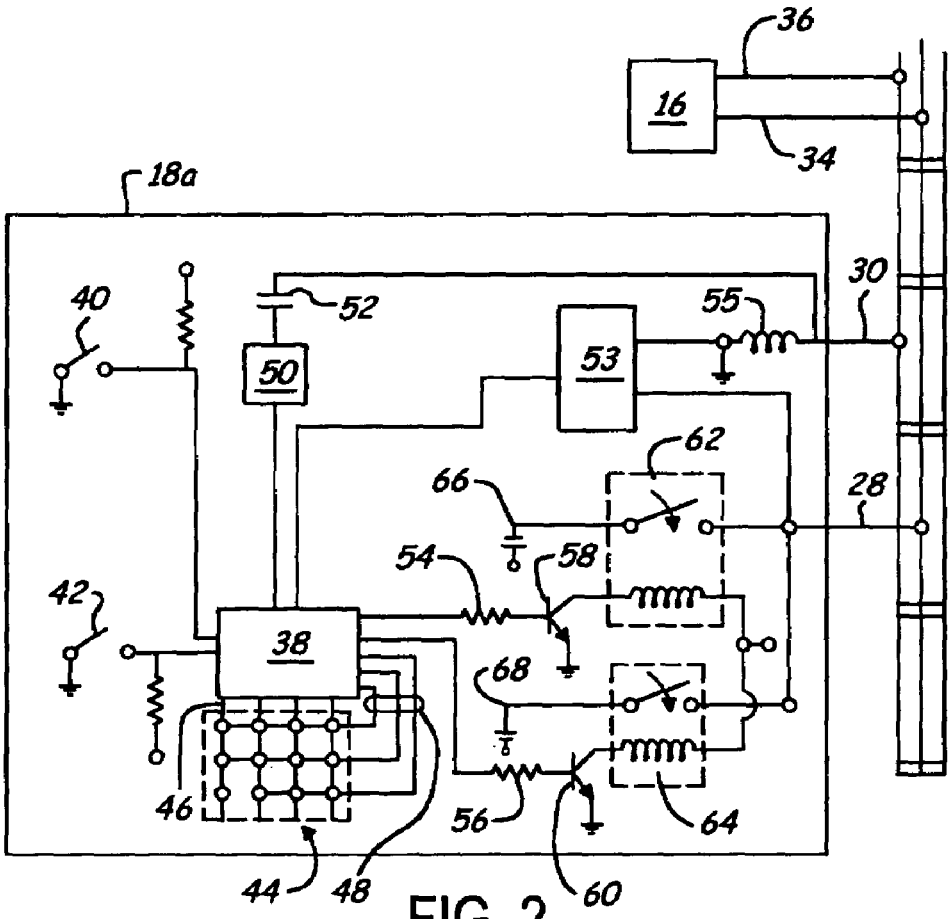
FIG. 2 is a schematic and block diagram view of the control box shown in FIG. 1.

FIG. 2 shows a schematic diagram of a first embodiment of the control box of FIG. 1, designated control box 18*a*, which is suitable for use with a typical three rail O-gauge AC-powered layout. As can be seen, connector 30, connected between control box 18*a* and the outside rail of track 14, is provided as a common node. Similarly, connector 36, which is the ground or common terminal of transformer 16, is also connected to the outside rail of track 14. In another embodiment, instead of connecting connector 30 directly to track 14, it can be connected to the common terminal on transformer 16. Connector 28 extends from control box 18*a* to the center rail of track 14. Connector 28 allows for DC offset control signals, which are generated by the circuitry of control box 18*a*, to be sent to the control electronics 20 of train 12 to perform the operating features selected by the user. In another embodiment, instead of being connected directly to track 14, connector 28 can be connected to the power terminal on transformer 16.

Control box 18*a*, in the illustrative embodiment, includes a controller 38. Controller 38 may comprise a conventional microcontroller or a microprocessor unit (MPU) with associated memory and an input/output interface. In this embodiment, controller 38 is suitably configured through software to perform the functions described herein. Of course, the functions herein described with respect to controller 38 can be performed in whole or in part by equivalent analog and/or digital circuitry. Controller 38, in response to inputs provided by pushbuttons 32 sends signals to track 14 signaling the control electronics 20 of a train 12 to operate certain advanced operating features of train 12. The process of determining the desired action or desired operating feature to be activated on model train 12, the preparation of an appropriate digital message to effect the desired action or operating feature, the transmission of the digital message to the receiver in the model train, and the configuration of the model train to receive the digital message, may all be as set forth in U.S. Pat. Nos. 5,251,856, 5,441,223 and 5,749,547 hereby incorporated by reference for at least such purpose. Of course, other approaches, as mentioned above, are possible and still remain within the spirit and scope of the present invention.

The embodiment shown in FIG. 2 includes optional protocol selection mechanism for allowing a user to select the protocol(s) for operation. As described above and in greater detail below, in a constructed embodiment, control box 18 is configured for one command control protocol (e.g., TRAINMASTER command control). In the illustrated embodiment, however, a first switch 40 and a second switch 42 are provided for the purpose of selecting one or more of a plurality of protocols. As previously discussed, many methods of controlling model trains have been proposed and implemented. In the embodiment of FIG. 2, the two forms for the control signals may correspond to a protocol described in the patents to Severson et al., identified above for actuation by conventional signaling (e.g., DC offsets), and a command control mode (e.g., TRAINMASTER command control system). While these two modes have been discussed above, they are meant to be exemplary only and not limiting in nature. One of ordinary skill in the art will appreciate that other control approaches exist, that are within the spirit and scope of the present invention. In each of these methods, the train being controlled responds to signals sent in different forms. In the protocol according to the Patents issued to Severson et al. using conventional signaling methods, the signals sent to a train 12 comprise a plurality of positive and negative DC offsets superimposed on the AC track voltage, with short interruptions in AC power changing the state of the motor. These DC offset signals are supplied to an on-board state generator that is part of the control electronics 20, which activates a train operating feature depending upon both the state and the order of positive and negative signals superimposed on the track voltage. The command control method, such as the TRAINMASTER command control system protocol, describes the use of digital messages independent of the level of track power. The digital messages are addressed and transmitted on track 14, and are received by the addressed engines. However, other transmission methods exist, such as radio frequency (RF) transmission, which remain in the spirit and scope of the present invention. This method preferably does this with a frequency shift key (FSK) modulation technique. Each train, such as train 12, has a receiver unit that looks for its unique address, receives the data corresponding to its address and then uses the data to control operation of train 12 and its advanced operating features. The receiver unit is thus part of the control electronics 20 of the train 12. The foregoing is exemplary and not limiting in nature.

With continued reference to FIG. 2, when the first switch 40 is closed, control box 18 transmits signals to track 14, and therefore, control electronics 20 in one form. When second switch 42 is closed, control box 18*a* transmits signals to track 14, and therefore, control electronics 20 in a second form. When both switches 40, 42 are closed, control box 18*a* transmits signals to track 14 destined for control electronics 20 in both forms. For the embodiment shown, control box 18*a* receives power by plugging box 18*a* into a conventional wall outlet. Then, the controller 38 adds a signal conforming to the command control method when switch 40 is closed. Alternately, or in addition to this signal, the controller 38 controls the DC offsets applied to track 14 for control electronics 20 receiving signals when switch 42 is closed. Of course, more than two forms for the signals are possible through the inclusion of additional switches or selection means (e.g., a software controlled interface). Switches 40, 42 as shown are manual switches, such as, for example, slide switches, associated with control box 18*a* and located on the casing of control box 18, which the user can set. However, it should be noted that the use of switches to carry out this functionality is illustrative only and not meant to be limiting in nature. Other selection means exist that remain within the spirit and scope of this invention.

In operation, the controller 38 continuously monitors whether a pushbutton 32 of control box 18*a* has been selected or depressed by the user, indicating the user's desire to activate the operating feature indicated by the corresponding label on the pushbutton so depressed. In the embodiment depicted in FIG. 2, the electrical connections of the pushbuttons 32 are represented by the grid 44. Grid 44 comprises a plurality of column selects 46 and row selects 48. Preferably, controller 38 continuously scans grid 44 by sequentially scanning one column and row by respectively selecting one column select 46 and row select 48 and looking for closures indicating a key press. The keypress is recorded. A first look-up may be performed by controller 38 so as to determine what desired action or operating feature has been selected by the user based on row/column. A second look-up may be performed by controller 38 in order to determine what digital messages, or other signaling is required in order to effect the desired action or operating feature. The controller 38 may then transmit the signals in a form appropriate to the selected protocol(s). It should be noted, however, that this grid methodology is exemplary only and not limiting in nature. Other methods exits, such as using separate inputs into controller 38 for each operating feature that remain within the spirit and scope of the invention.

In this regard, when switch 40 is closed (e.g., command control mode), controller 38 sends an appropriate data stream, based upon the pushbutton 32 pressed, to a transmitter 50. Transmitter 50 is coupled (e.g., for example only, through a coupling capacitor 52) to tracks 14 and inductor 55. Inductor 55 allows use of a 455 kHz FSK modulator scheme by blocking the 455 kHz from going to ground, while transmitter 50 places the requested data stream on track 14 using the selected form or protocol (e.g., command control protocol). Thus, any train 12 on track 14 with control electronics 20 able to process these commands will appropriately respond to the command.

Conventional Speed Control Simulator. Many model trains, when operating in a command control mode (eg. TRAINMASTER control mode), do not respond to conventional variations of track voltage for purposes of varying speed of the model train, but rather are configured to respond to digital messages containing a desired speed command. However, users are most familiar with the tactile, conventional approach for speed control, namely mechanically varying a potentiometer or the like on a transformer for varying the speed. The present invention reconciles these considerations by providing a speed control feature to be described below. An additional feature of control box 18*a* operating in the command control mode relates to obtaining and then sending speed commands to train 12. To control the speed of train 12, control box 18*a* must format and transmit a speed control message to train 12. In this regard, control box 18*a* includes a voltage sensor 53 which allows controller 38 to sample the voltage applied to track 14 by transformer 16, which is external to control box 18*a*. Accordingly, through connectors 28 and 30, controller 38 continuously monitors and reads the voltage supplied to track 14. Controller 38 is configured to infer, based on the level of the track voltage, what speed the user wishes the model train to travel. Based on the sampled voltage, controller 38 prepares a speed command message which controller 38 then sends to the control electronics 20 of train 12. Depending on the varied voltage on track 14, as monitored by controller 38 via voltage sensor 53, control electronics 20 then either increase, decrease, or maintain the speed of train 12. Thus, while train 12 does not respond to voltage variations applied to track 14 directly in terms of changing its speed, it does respond to digital speed control messages from control box 18*a*. Therefore, train 12 relies on control box 18*a* to monitor the voltage variations, and then command control electronics 20 to change the speed accordingly.

By way of example, assume that the layout 10 is an AC-powered, 3-rail, O-gauge layout and that transformer 16 is a conventional, variable output transformer 16 having an output ranging from 0 volts AC to 18 volts AC. Additionally assume that the control box 18*a* is configured so as to be compatible with a command control protocol (e.g., TRAINMASTER command control system) and that model train 12 is an engine that is compatible with such protocol.

Further assume that there is a minimum voltage needed to commence movement of train 12, say, for purposes of example only, 9 volts. Those of ordinary skill in the art will recognize that a model train 12 can be constructed to have a much lower movement threshold, perhaps as low as zero or near zero. However, the 9 volt level is level associated with commercially available model trains and will therefore be used without diminishing the generality and broad applicability of the present invention.

In this example, the protocol under which the control box 18*a* operates includes so-called absolute speed commands, such command taking the general form shown in equation (1):

$$\text{Engine [\#1 or \#2] Absolute Speed [0-31].} \quad (1)$$

Figure 4:
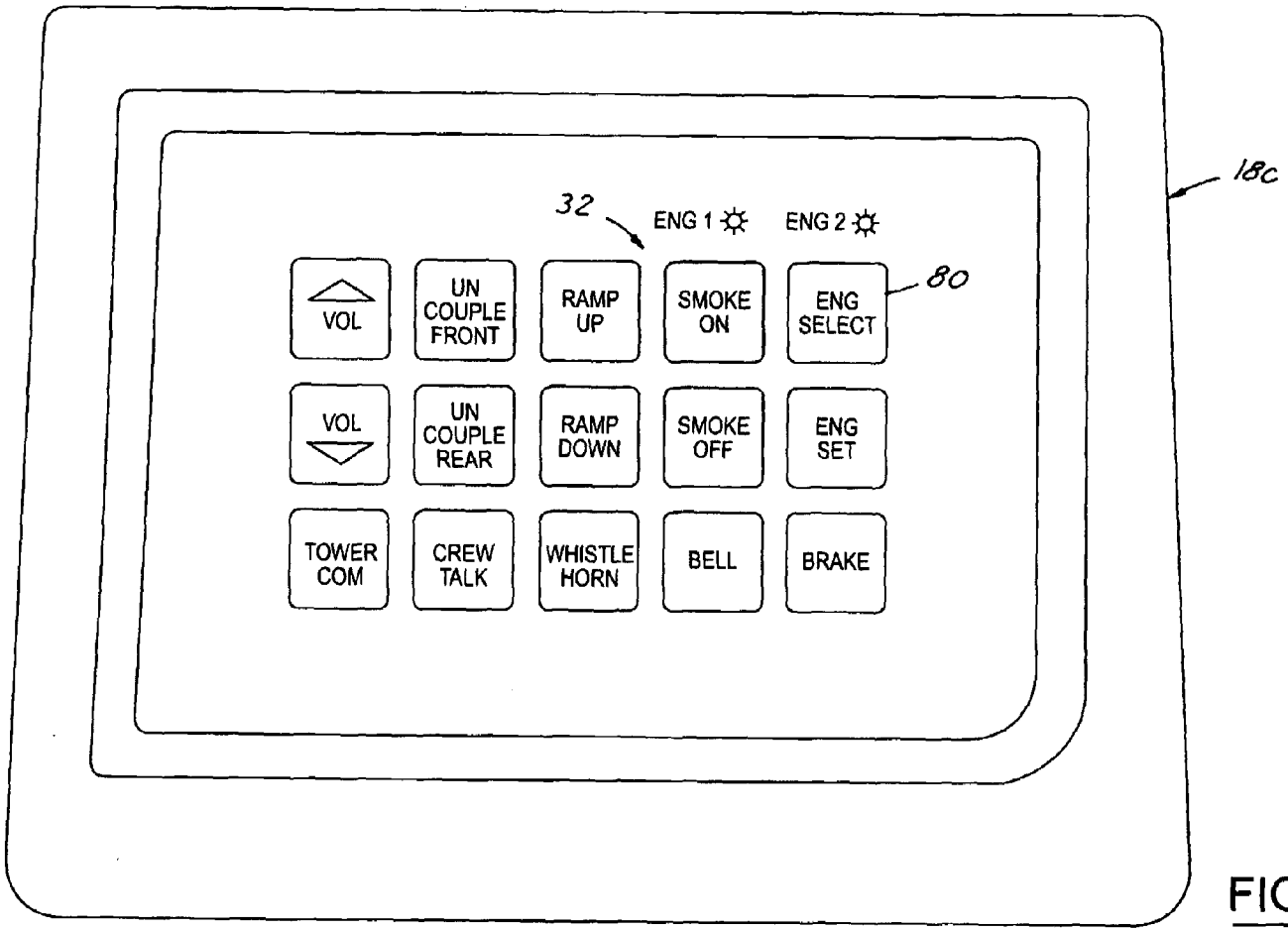
FIG. 4 is front face view of still another embodiment of the control box in accordance with the present invention.

Control box 18*a* is configured to format a digital message to be transmitted to model train 12 in the form of equation (1). Equation (1) also provides for the selection of either a first model train 12 (i.e., engine #1) or a second model train 12 (i.e., engine #2) as the destination for the command. This is best shown in the embodiment of FIG. 4. The exemplary protocol also provides for thirty-two discrete steps to which an absolute speed for the model train 12 may be commanded. It should be understood that the foregoing is exemplary only and not limiting in nature.

Assume the user adjusts the variable output transformer 16 so that it outputs 12 volts. There are several approaches that control box 18*a* may employ in order to develop a suitable speed command, (1) linear step approach and (2) non-linear step approach.

Linear Steps. In this embodiment, any voltage applied to the track by the user's adjustment of the transformer, as read by the control box 18*a*, that is below the movement threshold is assigned a "zero" step or halt level. Any track voltage above the zero-movement threshold level is determined as follows:

$$((\text{Sampled Track Voltage}-\text{Zero-Movement Threshold})/(\text{Max Voltage}-\text{Zero-Movement Threshold}))*32(\text{steps}) \quad (2)$$

In the example, a sampled track voltage of 12 volts yields:

$$(12-9)/(18-9)*32=3/9*32 \text{ approx. } 10.$$

In this example, using a linear step approach (i.e., evenly spaced increases in track voltage for incrementing the step level in the speed command), an absolute speed command parameter would be ten (10).

Non-Linear Steps. This approach is similar to the above linear step approach but does not require evenly-spaced steps for incrementing the speed command parameter. For example, it is often desirable to require larger increases in the voltage on the track before incrementing to the next step level. This is to provide, for example, greater sensitivity on the low end of the voltage scale, where end-users typically wish greater control (e.g., to observe the operation of the model train 12, to perform a delicate operation, or the like). In all other respects, the non-linear approach would be similar to the linear approach. This is not limited to but could be implemented by translating or looking up the difference in voltage above the zero point and translating it to a given speed step.

Execution of the Speed Command in the Model Train. Once the speed command is received by the model train, it must be executed by the control electronics 20. Under an open loop approach, the control electronics 20 would apply the prevailing track voltage in accordance with the commanded speed step level (e.g., the 12 volts would be applied at a duty cycle of 10/32). Of course, other electric control methodologies may be employed and remain within the spirit and scope of the present invention. Under a closed loop approach, the speed command may be translated into a motor speed (not model train speed) parameter, and using a sensor or the like associated with the motor, the voltage on the track can be adjusted using known methods in order to maintain the desired motor speed parameter. In this example, the speed command of ten (10) calculated above under either the linear or nonlinear approach may translate to X revolutions per minute. Control electronics 20 would then apply the needed voltage from the track in order to meet and maintain the X rpm of the motor. Through the foregoing, the invention enables the user to continue to adjust the variable output transformer in a conventional manner, although the actual control of the speed of the model train 12 is controlled by control box 18*a*. Maintaining transparency to the user is a particularly important feature of the present invention Through the foregoing, the present invention maintains, for the benefit of the user, a familiar conventional interface for speed control while in reality implementing a command control based speed control system through box 18.

In this illustrated embodiment, the digital speed control messages prepared by controller 38 and sent by control box 18*a* to train 12, which are referred to above, are in the nature of absolute speed messages, as opposed to relative speed messages. One advantage of the present invention is that a queue technique is used wherein the absolute speed message sent to the train is repeated a predetermined number of times in order to increase the reliability of the system. Additionally, equal priority is given to each speed message sent, be it to one train or two, so that one message is not dominating the communication path. In operation, this queue technique allows for five possibilities of transmission: the speed of a first train, the action of a first train (i.e., horn, lights, etc.), the speed of a second train, the action of a second train, and remote control. The system sequences through the possibilities and decides what function(s) and train are being selected, and then depending on the selected functions and whether it is an initial signal or a repeated signal, an order of transmission is established. The system then sends the function(s) to train(s) 12. For example, if the speed of a first train was adjusted, and the horn of that same train was selected, the system would send the commands in a sequence such as "Speed, Horn, Speed, Horn, etc."

When the switch 42 is closed (e.g., conventional signaling mode), signals according to the DC offset method are enabled. When the controller 38 detects the operation of a pushbutton 32, controller 38 provides a DC offset signal to track 14 through the connector 28. This DC offset signal is a signal conforming to the DC offset method for the command indicated by the pushbutton 32 pressed. Thus, signals start when controller 38 applies a positive logic signal to one of resistors 54 and 56. When a positive logic signal is applied to one of the resistors 54, 56, a transistor 58, 60 is respectively turned on. That is, current flows through the transistor 58 or 60. As seen in FIG. 2, each resistor 54, 56 is respectively connected to the base of a transistor 58, 60, while the emitter of each transistor 58, 60 is grounded. The collector of each transistor 58, 60 is respectively connected to a relay 62, 64. The relays are not shown in detail, but are contemplated herein as being electromechanical relays. However, it should be noted that the relays in this embodiment are used for illustrative purposes only and are not meant to be limiting in nature. In other embodiments devices such as solid state devices may be used instead of relays.

A negative DC offset supply 66 is associated with relay 62 such that the closing of the switch in relay 62 generates a negative DC offset applied to track 14 through connector 28. Similarly, a positive DC offset supply 68 is associated with relay 64 such that the closing of the switch of relay 64 applies a positive DC offset to track 14 through the connector 28. A command conforming to the DC offset method (i.e., the method of Severson et al.) is sent by controller 38 by varying the distance and spacing of the DC offsets from the DC offset supplies 66 and 68. Of course, this logic can be done in many different ways known to those skilled in the electronics discipline. For example, transistors, thyristors, etc., may replace the relays. A train 12 riding on track 14 with control electronics 20 operable to receive signals conforming to the DC offset method will appropriately respond to the command.

Figure 3:
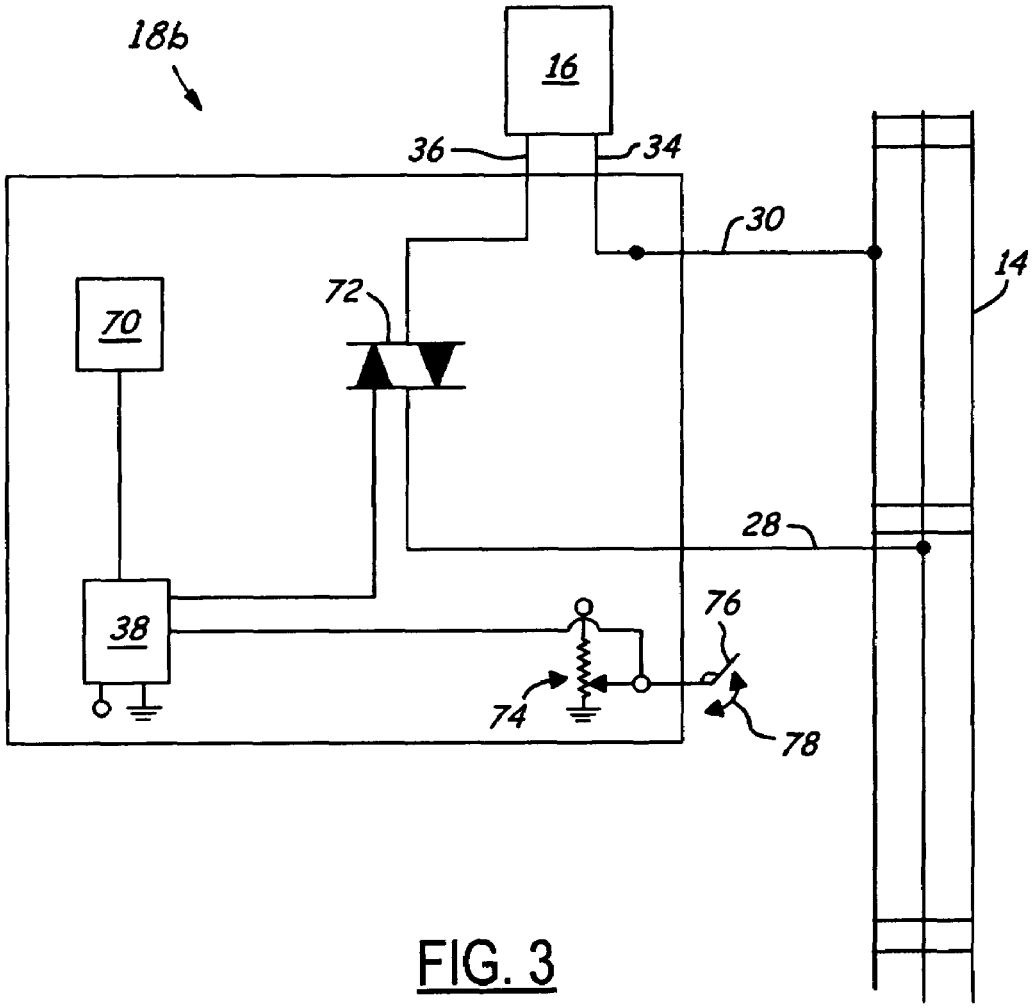
FIG. 3 is a schematic and block diagram view of another embodiment of the control box according to the present invention.

An another embodiment of the control box of FIG. 1 is shown in FIG. 3, and is designated control box 18*b*. Other than as described below, the control box 18*b* is the same as control box 18*a*. Accordingly, a repeat description will not be made. FIG. 3 shows the incoming power re-controlled by using a set of power devices and a separate throttle control on the control box 18*b*. In this view, the switches 40, 42, grid 44, column selects 46 and row selects 48 are omitted. As mentioned above, this grid method is meant to be exemplary and not limiting in nature. For simplicity the transmitter 50, coupling capacitor 52, and voltage sensor 53 are also omitted.

The preferred mode of operation in this embodiment is to turn the transformer to a maximum value to allow for the greatest range in adjusting the power level provided to the track 14. In control box 18*b*, connector 36 from transformer 16 is connected to the input of a triac 72 located in control box 18*b*, while connector 34 from transformer 16 to control box 18*b* is coupled to connector 30 between the control box 18*b* and track 14. The connection formed by connectors 30 and 34 provides either a DC or an AC voltage to track 14. Controller 38 receives as its input the inputs from grid 44 and a 60-Hz reference from the circuit 70. The circuit 70 can be, for example, a zero-crossing detector detecting a 60-Hz reference as a zero crossing point of the supply from transformer 16 to track 14 flowing along the connection formed by connectors 30 and 34. Such zero-crossing detectors are well known in the art and thus are not illustrated. The 60-Hz reference supplied by the circuit 70 is used by controller 38 in control of a triac 72, in order to supply an average power and DC offsets.

To use triac 72 for this purpose, controller 38 also receives an input from a potentiometer 74. The setting of potentiometer 74 is responsive to the movement of a lever 76 in the direction indicated by arrow 78. In response to changes of the impedance of potentiometer 74, controller 38 calculates a phase conduction angle for the supply through triac 72. The phase conduction angle is the total angle over which the flow of current to track 14 through triac 72 and connector 28 occurs, delivering an average power from transformer 16. By means of triac 72, and according to known methods, a DC offset can also be controlled and varied to supply a signal in accordance with the DC offset method to track 14. Thus, relays are unnecessary in this embodiment, as are the DC offset supplies 66 and 68. While in this illustrated embodiment a potentiometer 74 is used, it should be noted that other means exist, such as buttons, keys or remote control, to carry the same functionality. Of course, triac 72 could instead be another control device. For example, a MOSFET can control power from a DC power source 16, whereas the configuration of FIG. 3 is directed to an AC transformer 16.

FIG. 4 shows a front face view of still another embodiment of the control box of FIG. 1, designated control box 18*c*. It should be noted that control box 18 in accordance with the present invention can also be utilized to control the advanced operating features on trains operating on two or more different blocks of track or two trains on one track. Control box 18*c* is an embodiment suitable for use in controlling two blocks of layout 10. Multiple control boxes, for example, control boxes 18*c*, may be employed to control further blocks (in excess of two) included in layout 10. To carry out this functionality, control box 18*c* includes a selection device 80 that allows the user to switch between the two model trains. Altering the throttle of a particular train will also cause control box 18 to automatically switch to that train. Each model train operating in the layout has a distinct address. Depending on which train is selected, either automatically or manually, as the pushbuttons 32 are depressed, the control box 18 sends control signals to the address associated with the selected train that will be performed only by that particular train to actuate its advanced operating features.

Figure 5:
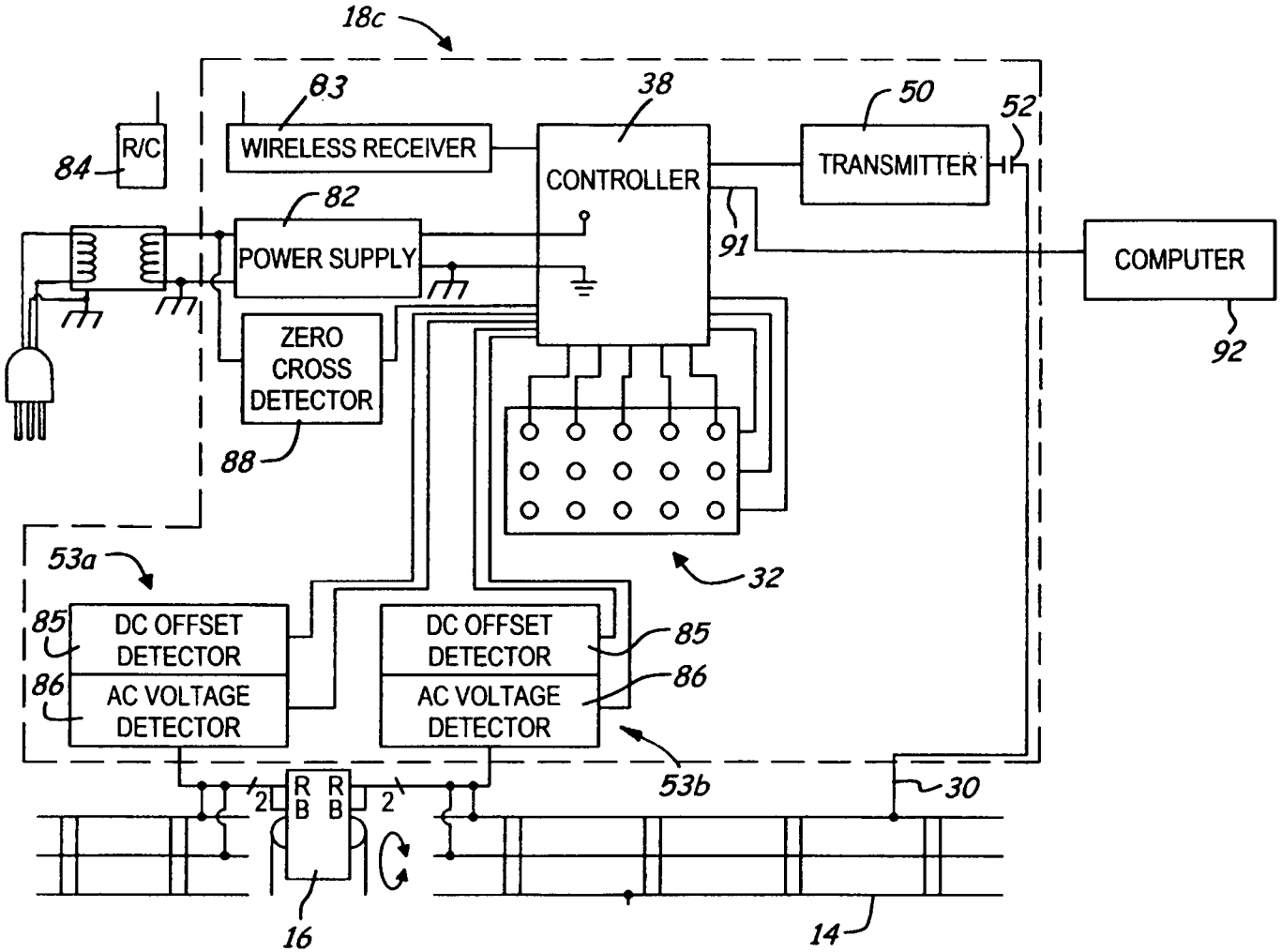
FIG. 5 is a schematic and block diagram view corresponding to the embodiment of the control box of FIG. 4.

FIG. 5 shows a block diagram of control box 18*c* of FIG. 4, which is suitable for use with a typical three rail O-gauge AC powered layout. Other than as described below, the control box 18*c* is the same as control box 18*a*. As can be seen, connector 30 is connected from control box 18*c* to the outside rail ("common") of track 14. Connector 28 extends from control box 18*c* to the center rail of track 14.

In this constructed embodiment, control box 18*c* comprises a power supply 82; a wireless receiver 83 for receiving signals sent from a remote control 84; a pair of AC/DC voltage sensors 53*a*, 53*b* connected to transformer 16 and wherein each is comprised of a DC offset detector 85 and an AC voltage detector 86; and a zero-cross detector 88, all of which are connected to controller 38. Control box 18*c* further includes a user interface allowing the user to input their selection, for example selection devices such as a keypad of pushbuttons 32, which is also connected to controller 38. Control box 18*c* is further comprised of a transmitter 50 connected to the output of controller 38, and a connection to an external computer 92 connected to the output of controller 38 through an interface 91, such as a serial interface. However, this interface could also be other methods now known or later developed such as parallel and USB interfaces. Transmitter 50 is configured to input digital messages onto track 14 using, for example, a FSK modulation scheme (i.e., a 455 kHz digital signal generator). The output of transmitter 50 is connected to the outside rail of track 14 and inductor 55 by way of a coupling capacitor 52. Inductor 55 allows use of a 455 kHz FSK modulator scheme by blocking the 455 kHz from going to ground. Control box 18*c* is powered by a conventional wall outlet in conjunction with power supply 82. In addition to reducing the voltage provided by the wall outlet to a level sufficient to power the circuitry of control box 18*c*, one wire of power supply 82 is tied to the earth ground of the wall outlet in order to establish a ground plane which is used as a reference for the command signals issued by the command control protocol, and to create a return path for these signals.

Controller 38 may comprise a conventional microcontroller or a microprocessor unit (MPU) with associated memory and an input/output interface. In this embodiment, controller 38 is suitably configured through software to perform the functions described herein. Of course the functions herein described with respect to controller 38 can be performed in whole or in part by equivalent analog and/or digital circuitry. Controller 38, in response to inputs provided by pushbuttons 32 sends command control signals to track 14 by way of digital signal transmitter 50, signaling the control electronics 20 of a train 12 to operate certain advanced operating features of train 12. The process of determining the desired action or desired operating feature to be activated on model train 12, the preparation of an appropriate digital message to effect the desired action or operating feature, the transmission of the digital message to the receiver in the model train, and the configuration of the model train to receive the digital message, may all be as set forth in U.S. Pat. Nos. 5,251,856, 5,441,223, and 5,749,547 hereby incorporated by reference for at least such purpose. Of course, other approaches, as mentioned above, are possible and remain within the spirit and scope of the present invention.

As stated above, controller 38 causes command control signals to be sent to track 14, and therefore, to train 12. The command control method, such as the TRAINMASTER command control system protocol, describes the use of digital messages independent of the level of track power. The digital messages are addressed and transmitted on the track, and are received by the engines. If the engine recognizes the address, it processes and carries out the digital message. If the engine does not recognize the address, it does nothing. The preferred method of carrying out this functionality is to use a FSK modulation technique. Each train, such as train 12, has a receiver unit that looks for its unique address, receives the data corresponding to its address and then uses the data to control operation of train 12 and its advanced operating features. The receiver unit is thus part of the control electronics 20 of the train 12. The foregoing is exemplary and not limiting in nature.

In operation, the controller 38 continuously monitors whether a pushbutton 32 of control box 18*c* has been depressed by the user, indicating the user's desire to activate the operating feature indicated by the corresponding label on the pushbutton so depressed. In the embodiment depicted in FIG. 5, separate inputs into controller 38 for each operating feature the electrical connections of the pushbuttons 32 are used. However, it should be noted that this is exemplary only and not limiting in nature. For instance, the electrical connections may be represented by a grid which comprises a plurality of column selects and row selects, and whose operation has been described in detail above. When controller 38 finds that a pushbutton has been selected, a look-up may be performed by controller 38 in order to determine what digital messages, or other signaling is required in order to effect the desired action or operating feature. The controller 38 may then transmit the signals in a form appropriate to the selected protocol(s).

In this regard, controller 38 sends an appropriate data stream, based upon the pushbutton 32 pressed, to transmitter 50. Transmitter 50 is coupled (e.g., for example only, through a coupling capacitor 52) to tracks 14. Transmitter 50 places the requested data stream on track 14 using the selected form or protocol (e.g., command control protocol). Thus, any train 12 on track 14 with control electronics 20 able to process these commands will appropriately respond to the command.

Conventional Speed Control Simulator. Many model trains, when operating in a command control mode (eg., TRAINMASTER control mode) do not respond to conventional variations of track voltage for purposes of varying speed of the model train, but rather are configured to respond to digital messages containing a desired speed command.

However, the users are most familiar with the tactile, conventional approach for speed control, namely mechanically varying a potentiometer or the like on a transformer for varying the speed. The present invention reconciles these considerations by providing a speed control feature to be described below.

An additional feature of control box 18*c* operating in the command control mode relates to obtaining and then sending speed commands to train 12. To control the speed of train 12, control box 18*c* must format and transmit a speed control message to train 12. This method of speed control is carried out as follows. An AC waveform is applied to track 14 by transformer 16. This AC waveform is also sampled through voltage sensors 53*a* or 53*b* (i.e., a peak detector for exemplary purposes only) of control box 18*c*, depending on whether there are one or two trains operating, and which train's speed is being adjusted, which are connected between the output of transformer 16 and the input of controller 38. However, for the sake of simplification and illustrative purposes, only one voltage sensor 53 will be referred to hereinafter.

Figure 6:
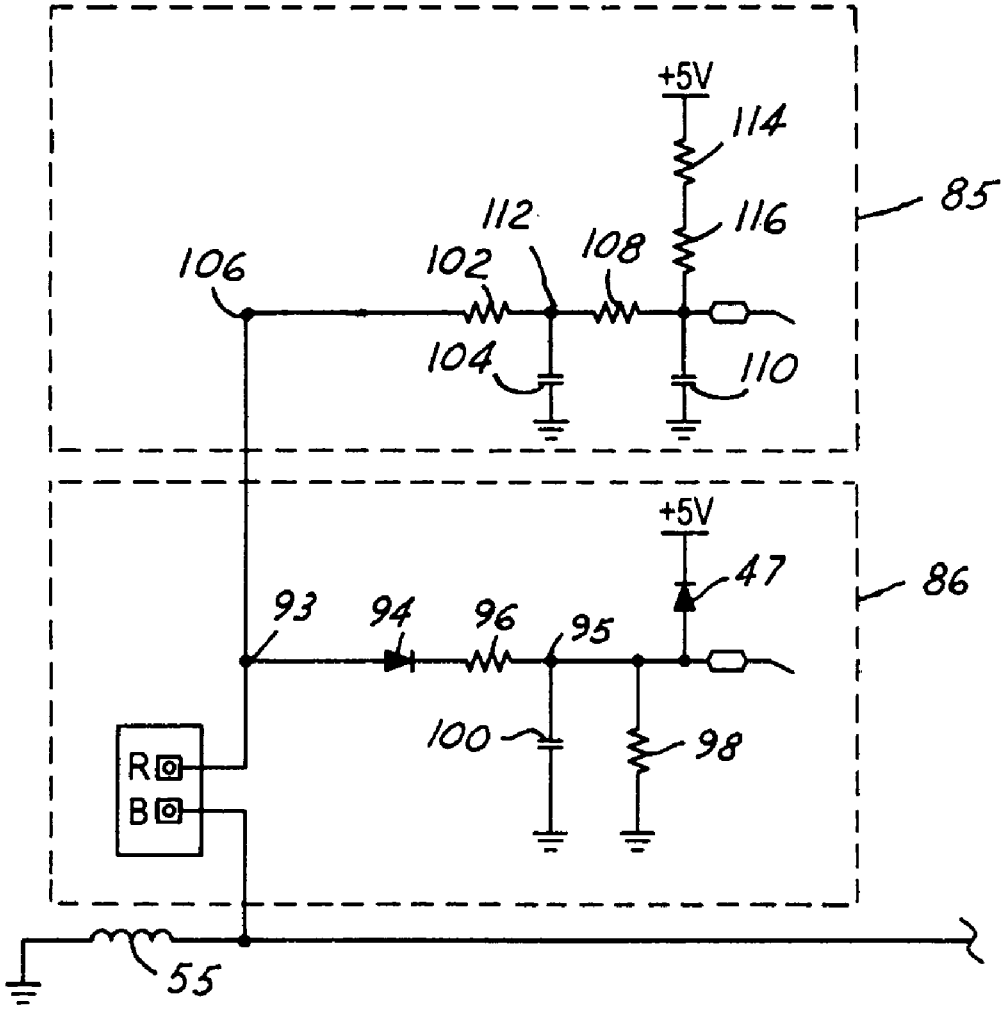
FIG. 6 is schematic diagram showing, in greater detail, AC and DC voltage detectors of FIG. 5.

With reference to FIG. 6, in one embodiment, DC voltage detector 85 comprises a combination of resistor 102 and capacitor 104 connected in series between node 106 and ground, and a combination of resistor 108 and capacitor 110 connected in series between node 112 and ground. The combination of resistor 102 and capacitor 104 is connected in series with the combination of resistor 108 and capacitor 110 at node 112 so that capacitor 104 and capacitor 110 are configured in a parallel configuration. Additionally, detector 85 includes a combination of resistor 114, resistor 116, and capacitor 110 connected in series between the 5 volt voltage source and ground. AC voltage detector 86 is comprised of a combination of a diode 94 and resistor 96 connected in series between nodes 93 (i.e., the transformer output) and node 95. A parallel combination of a resistor 98 and capacitor 100 are provided between node 95 and a ground node. A diode 97 clamps the voltage on node 95 to Vcc, or 5 volts in this embodiment, so as to protect the analog-to-digital (A/D) circuitry in controller 38. AC detector 86 is used to continuously condition the AC voltage for sampling by controller 38 in order to allow for a speed message to be generated.

Figure 7:
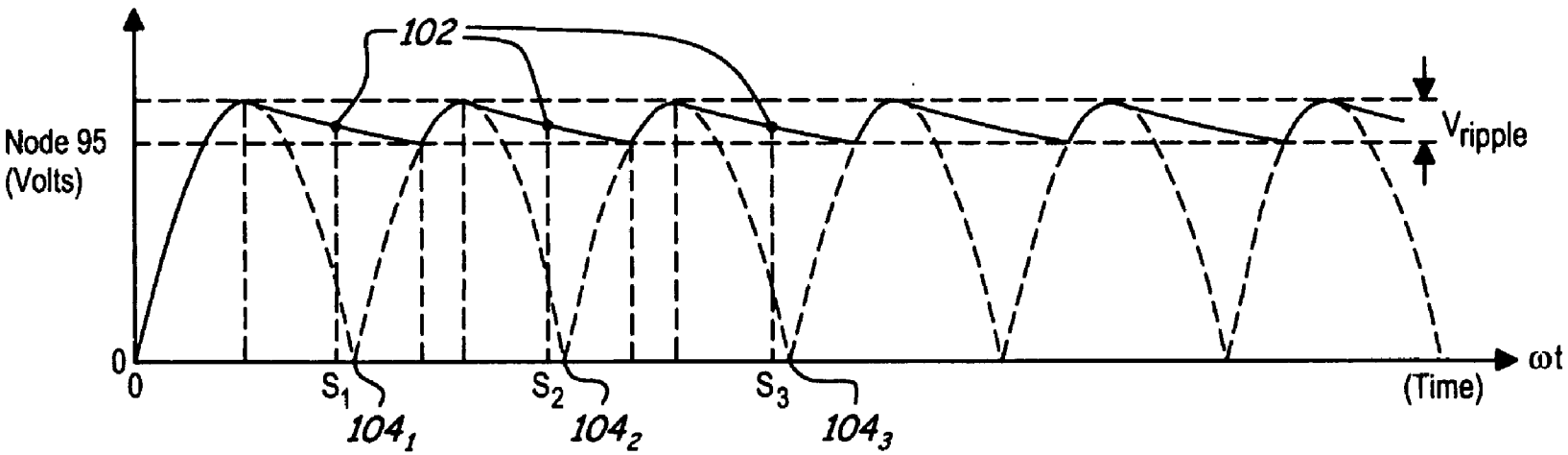
FIG. 7 is a waveform showing the voltage output of the AC voltage detector of FIG. 6.

Referring now to FIGS. 6 and 7, due to the configuration of the detector 86, particularly the size of capacitor 100, there will be a "ripple" or fluctuation of the voltage on node 95. Since the voltage is continuously sampled, care must be taken to do so in a way to achieve consistent results. For example, the ripple is periodic in this instance, and sampling at different "times" could result in different voltage levels being read when in fact the voltage on the track as adjusted by the user has remained constant. This inconsistency in sampling would cause the model train to randomly either speed up or slow down, even when the user has not requested the train to do so. In order to prevent this from occurring, it is desirous to sample the voltage at the same point of the waveform each and every time. Accordingly, a reference point at which the voltage is to be sampled for each cycle of the waveform is needed. Once a reference point on the waveform is established, the waveform is sampled at a sampling point occurring a predetermined offset time interval following the detection of the reference point. The waveform is then continuously sampled each additional time that the reference point is detected.

In the present invention, the zero-cross of an unrectified, power-on-the-track waveform is used as a reference point. In order to sample the voltage at the zero-cross, a zero-cross detector 88 is connected between the input of power supply 82 and the input of controller 38. However, it should be noted that transformer 16 and power supply 82 are operating on the same sourced AC waveform, therefore, zero-cross detector 88 may also be connected in alternate configurations, such as between the output of transformer 16 and the input of controller 38. FIG. 7 shows a rectified AC waveform as would be seen at the output of the AC voltage detector 86 depicted in FIG. 6.

In operation, each time the unrectified waveform (not shown) crosses through a zero point 104 (as shown in FIG. 7), a signal will be sent to controller 38 indicating that a sample needs to be taken following the predetermined offset time interval. Therefore, with reference to FIG. 7, zero-cross detector 88 detects a zero-cross at the origin and communicates this to controller 38. Controller 38 samples the voltage conditioned and output by AC voltage detector 86 at a sampling point $S_1$ following the offset time interval beginning at the origin and ending at $S_1$. Zero-cross detector 88 then detects the zero-cross at reference point $\mathbf{104}_1$, and controller 38 samples the voltage at sampling point $S_2$ following the predetermined offset time interval beginning at reference point $\mathbf{104}_1$ and ending at sampling point $S_2$. This process continues at each successive zero-cross reference point $\mathbf{104}_2$, $\mathbf{104}_3$, etc., and each corresponding sampling point $S_3$, $S_4$, etc. The determination by controller 38 of the "track" voltage may then be made using the samples. This determination may include processing the samples (e.g., averaging, etc.).

Accordingly, controller 38 continuously monitors and reads the voltage supplied to track 14. Controller 38 is configured to infer by using a look-up table or otherwise, based on the level of the "track voltage" it has determined, what speed the user wishes the model train to travel. Controller 38 then prepares a speed command message, which controller 38 then applies to the track and is received by the control electronics 20 of train 12. Depending on the varied voltage on track 14, as monitored by controller 38 via voltage sensor 53, control electronics 20 then either increase, decrease, or maintain the speed of train 12. Thus, while train 12 does not respond to voltage variations applied to track 14 directly in terms of changing its speed, it does respond to digital speed control messages from control box 18*c*. Therefore, train 12 relies on control box 18*c* to monitor these voltage variations, and then command control electronics 20 to change the speed accordingly.

By way of example, assume that the layout 10 is an AC-powered, 3-rail, O-gauge layout and that transformer 16 is a conventional, variable output transformer 16 having an output ranging from 0 volts AC to 18 volts AC. Additionally assume that the control box 18*a* is configured so as to be compatible with a command control protocol (e.g., TRAINMASTER command control system) and that model train 12 is an engine that is compatible with such protocol.

Further assume that there is a minimum voltage needed to commence movement of train 12, say, for purposes of example only, 9 volts. Those of ordinary skill in the art will recognize that a model train 12 can be constructed to have a much lower movement threshold, perhaps as low as zero or near zero. However, the 9 volt level is level associated with commercially available model trains and will therefore be used without diminishing the generality and broad applicability of the present invention.

In this example, the protocol under which the control box 18*a* operates includes so-called absolute speed commands, such command taking the general form shown in equation (1):

Engine [#1 or #2] Absolute Speed [0-31]. (1)

Control box 18*a* is configured to format a digital message to be transmitted to model train 12 in the form of equation (1). Equation (1) also provides for the selection of either a first model train 12 (i.e., engine #1) or a second model train 12 (i.e., engine #2) as the destination for the command. This is best shown in the embodiment of FIG. 4. The exemplary protocol also provides for thirty-two discrete steps to which an absolute speed for the model train 12 may be commanded. It should be understood that the foregoing is exemplary only and not limiting in nature.

Assume the user adjusts the variable output transformer 16 so that it outputs 12 volts. There are several approaches that control box 18*a* may employ in order to develop a suitable speed command, (1) linear step approach and (2) non-linear step approach.

Linear Steps. In this embodiment, any voltage applied to the track by the user's adjustment of the transformer, as read by the control box 18*a*, that is below the movement threshold is assigned a "zero" step or halt level. Any track voltage above the zero-movement threshold level is determined as follows:

((Sampled Track Voltage−Zero-Movement Threshold)/(Max Voltage−Zero-Movement Threshold)) *32(steps) (2)

In the example, a sampled track voltage of 12 volts yields:

(12−9)/(18−9)*32=⅓*32 approx. 10.

In this example, using a linear step approach (i.e., evenly spaced increases in track voltage for incrementing the step level in the speed command), an absolute speed command parameter would be ten (10).

Non-Linear Steps. This approach is similar to the above linear step approach but does not require evenly-spaced steps for incrementing the speed command parameter. For example, it is often desirable to require larger increases in the voltage on the track before incrementing to the next step level. This is to provide, for example, greater sensitivity on the low end of the voltage scale, where end-users typically wish greater control (e.g., to observe the operation of the model train 12, to perform a delicate operation, or the like). In all other respects, the non-linear approach would be similar to the linear approach. This is not limited to but could be implemented by translating or looking up the difference in voltage above the zero point and translating it to a given speed step.

Execution of the Speed Command in the Model Train. Once the speed command is received by the model train, it must be executed by the control electronics 20. Under an open loop approach, the control electronics 20 would apply the prevailing track voltage in accordance with the commanded speed step level (e.g., the 12 volts would be applied at a duty cycle of 10/32). Of course, other electric control methodologies may be employed and remain within the spirit and scope of the present invention. Under a closed loop approach, the speed command may be translated into a motor speed (not model train speed) parameter, and using a sensor or the like associated with the motor, the voltage on the track can be adjusted using known methods in order to maintain the desired motor speed parameter. In this example, the speed command of ten (10) calculated above under either the linear or nonlinear approach may translate to X revolutions per minute. Control electronics 20 would then apply the needed voltage from the track in order to meet and maintain the X rpm of the motor. Through the foregoing, the invention enables the user to continue to adjust the variable output transformer in a conventional manner, although the actual control of the speed of the model train 12 is controlled by control box 18*a*. Maintaining transparency to the user is a particularly important feature of the present invention Through the foregoing, the present invention maintains, for the benefit of the user, a familiar conventional interface for speed control while in reality implementing a command control based speed control system through box 18.

In the constructed embodiment, the digital speed control messages prepared by controller 38 and sent by control box 18*c* to train 12, which are referred to above, are in the nature of absolute speed messages, as opposed to relative speed messages. One advantage of the present invention is that a queue technique is used wherein the absolute speed message sent to the train is repeated a predetermined number of times in order to increase the reliability of the system. Additionally, equal priority is given to each speed message sent, be it to one train or two, so that one message is not dominating the communication path. In operation, this queue technique allows for five possibilities of transmission: the speed of a first train, the action of a first train (i.e., horn, lights, etc.), the speed of a second train, the action of a second train, and remote control. The system sequences through the possibilities and decides what function(s) and train are being selected, and then depending on the selected functions and whether it is an initial signal or a repeated signal, an order of transmission is established. The system then sends the function(s) to train(s) 12. For example, if the speed of a first train was adjusted, and the horn of that same train was selected, the system would send the commands in a sequence such as "Speed, Horn, Speed, Horn, etc."

It should be noted that the above embodiments are exemplary only and not limiting in nature. Those skilled in the art will appreciate that in light of the foregoing disclosure, other embodiments and configurations exist that remain within the spirit and scope of this invention.

The invention claimed is:

1. A system for controlling operating features of a model train, comprising:

a transformer operative to provide a voltage to a block of track for a model train, the transformer including means for manually setting the voltage to select a desired speed of the model train;

a voltage sensor coupled to the block of track to sense the voltage provided thereon by the transformer;

a control box electrically and mechanically coupled to said track operative to allow for the selection and carrying out of operating features of said model train operating on said track in a command control mode of operation, comprising:

(i) a housing;

(ii) a plurality of selection devices mounted on said housing wherein each selection device corresponds to a respective operating feature of said train;

(iii) a controller connected to said selection devices, the controller configured to determine the desired speed of the model train from an input provided by the voltage sensor;

(iv) a transmitter electrically connected between the output of said controller and said track, and operative to generate digital messages corresponding to said selection devices and the desired model train speed, and further operative to inject said digital messages onto said track;

(v) a power supply connected to said controller and operative to provide suitable power to said controller; and a receiver on said train operative to receive said digital messages generated by said digital signal generator;

wherein an operator may control the speed of the train using the transformer means to vary the voltage applied to the track, and the control box converts the varying voltage to digital messages recognized by the train under the command control mode of operation.

2. A system in accordance with claim 1 further comprising:

a wireless receiver operative to receive signals generated and sent by a remote control;

said voltage sensor comprised of a DC offset detector and an AC voltage detector connected between said transformer and said controller;

a zero-cross detector connected between the output of said power supply and the input of said controller;

wherein said voltage sensor and said zero-cross detector are collectively operative to allow said controller to monitor the voltage being applied to said track and to generate and transmit corresponding speed command signals to said receiver on said train.

3. A system in accordance with claim 2 wherein said AC voltage detector is a peak detector device.

4. A system in accordance with claim 2 wherein said controller is operative to repeat said speed command signals to said receiver a predetermined number of times by using a queue technique.

5. A system in accordance with claim 2 wherein said zero-cross detector is connected between the output of said transformer and the input of said controller.

6. A system in accordance with claim 2 wherein said zero-cross detector is connected between the input of said power supply and the input of said controller.

7. A system in accordance with claim 1 further comprising a switching means for selecting between one of two of said trains that are operating on the same block of track or between a first and second train operating on separate blocks of track.

8. A system in accordance with claim 7 wherein said switching means is operative to actuate automatically to thereby select one said trains whose speed is altered.

9. A system in accordance with claim 1, wherein said plurality of selection devices are pushbuttons.

10. A system in accordance with claim 1, wherein said transmitter is operative to create said digital messages using a frequency shift key method; and wherein said receiver is operative to decode said digital messages.

11. A method of controlling the speed of a model train comprising the steps of:

selectively varying an amplitude of an AC waveform supplied to a block of track upon which said model train travels to control a desired speed setting of the model train;

detecting the AC waveform;

establishing a first reference point of said waveform;

sampling said AC waveform at a sampling point occurring after a pre-determined offset time interval following said reference point to obtain a sampled voltage level;

determining the desired speed setting corresponding to said sampled voltage; and sending a speed control message to said model train identifying the desired speed setting.

12. The method of claim 11 wherein said step of establishing a reference point includes the step of detecting the zero-cross point in the waveform using a zero-cross detector.

13. The method of claim 11 wherein the step of determining the desired speed setting further includes the substep of looking up the desired speed setting corresponding to said sampled voltage in a look-up table.

14. The method of claim 11 wherein the step of determining the desired speed setting further includes the substeps:

(i) setting a zero-movement threshold voltage;

(ii) processing said sampled voltage with said zero-movement threshold to determine the desired speed setting.

15. The method of claim 11 where said step of sending said speed control message further includes the step of repeating said speed control message a predetermined number of times using a queue technique.

16. An apparatus for controlling different model trains separately configured to respond to different non-interoperable command protocols, the apparatus comprising:

a user interface configured to indicate user input for controlling a user-selected type of a plurality of model train components;

a controller operably connected to the user interface, the controller operative to detect a user selection of a command protocol from a plurality of different non-interoperable command protocols, and to generate control signals for the model train components according to the user-selected command protocol;

a voltage sensor in communication with the controller, the voltage sensor disposed to sense a model track voltage, wherein the model track voltage is selectively variable to control a desired train speed in accordance with a conventional control protocol, the controller further determines the desired train speed responsive to an input from the voltage sensor; and a transmitter operably connected to said controller, the transmitter operative to transmit said control signals for controlling ones of the user-selected type of model train components that are responsive to the user-selected command protocol, said control signals including at least a speed control command in accordance with the user-selected command protocol and corresponding to the desired train speed as determined by the controller.

17. The apparatus of claim 16, further comprising a mode selection device operably connected to the controller, wherein the controller is configured to detect the user-selected command protocol based on an input state of the mode selection device.

18. The apparatus of claim 16, wherein the user interface comprises a plurality of user-settable switches each corresponding a type of the plurality of model train components.

19. The apparatus of claim 16, wherein the plurality of different non-interoperable command protocols are selected from the group consisting of: a digital addressable command control protocol, a conventional DC-offset protocol, and a constant-power DC-offset protocol.

20. The apparatus of claim 16, wherein the user interface further comprises a speed control input configured to control a voltage applied to a model train track for powering model train movement.

21. The apparatus of claim 20, wherein the user interface comprises a rotatable knob.

22. The apparatus of claim 20, wherein the controller is operative to detect the voltage applied to the model train track and to generate the speed control signal at periodic intervals.

23. An apparatus for controlling model train speed, comprising:

a controller operably associated with a memory, a voltage in put adapted to be coupled to a track carrying a model train, and a command output, wherein the memory holds program instructions for:

receiving an input voltage at the voltage input;

determining a commanded train speed based on the input voltage;

generating a speed command according to a command protocol, wherein the command protocol comprises a protocol selected from a digital command protocol and a DC-offset command protocol; and sending the speed command to the model train via the track using the command output;

wherein the controller converts a variable voltage input corresponding to a conventional control protocol speed command into the speed command recognized by the model train under the command protocol.

24. The apparatus of claim 23, further comprising a power supply configured to supply motive power over a variable voltage range to a model train via a power output, the power output operably connected to the voltage input of the controller.

25. The apparatus of claim 24, further comprising a user input device operably associated with the power supply, wherein the power supply is configured to supply the power at a voltage level determined by the user input.

26. The apparatus of claim 23, wherein the memory further holds program instructions for receiving the voltage, determining the commanded train speed, and generating the speed command at periodic intervals.

27. The apparatus of claim 23, wherein the memory further holds program instructions for determining the commanded train speed as a linear function of the voltage input.

28. The apparatus of claim 23, wherein the memory further holds program instructions for determining the commanded train speed as a non-linear function of the voltage input.

* * * * *